United States Patent [19]

Primich

[11] Patent Number: 4,704,795

[45] Date of Patent: Nov. 10, 1987

[54] ADJUSTABLE SCRAPER

[76] Inventor: John V. Primich, 337 Highland Rd., Kensington, 2094, Johannesburg, South Africa

[21] Appl. No.: 832,541

[22] Filed: Feb. 21, 1986

[30] Foreign Application Priority Data

Feb. 22, 1985 [ZA] South Africa ..... 85/1360

[51] Int. Cl.[4] ..... B26B 3/00

[52] U.S. Cl. ..... 30/169; 15/236 R; 30/478; 30/492

[58] Field of Search ..... 30/169, 478, 480, 485, 30/488, 492; 81/45; 15/236 R

[56] References Cited

U.S. PATENT DOCUMENTS 586,164 7/1897 Dehere ..... 30/169

1,567,342 12/1925 Szako ..... 30/478 X

*Primary Examiner*—Douglas D. Watts

*Attorney, Agent, or Firm*—Browdy and Neimark

[57] ABSTRACT

A scraper device comprises a carrier presenting a working face and including two slot formations disposed at different angles to the plane of the working face. An elongate scraper blade, such as a conventional hack saw blade, is releasably mountable in either one of the slot formations in either of two operative positions. In each of the operative positions the working edge of the scraper blade protrudes transversely from the working face and portion of the scraper blade can project from the carrier on at least one side of the carrier to permit a projecting portion of the scraper blade to be severed from a portion of the blade which is operatively mounted on the carrier.

6 Claims, 3 Drawing Figures

ADJUSTABLE SCRAPER

This invention relates to scrapers.

According to the invention a scraper device includes a carrier which presents a working face, the carrier being adapted removably to mount an elongate scraper blade such that a longitudinally extending working edge of the scraper blade protrudes transversely from the working face and portion of the scraper blade can project from the carrier on at least one side of the carrier to permit a projecting portion of the scraper blade to be severed from a portion of the blade which is operatively mounted on the carrier.

With the arrangement according to the invention a portion of a conventional hacksaw blade may be used as the scraper blade, successive portions of the blade being operatively mountable in the carrier one after the other as a preceding portion becomes worn and a projecting portion of the blade of progressively decreasing length being snapped off for removal from the scraper each time a new portion of the blade is operatively mounted on the carrier.

The carrier may include at least one slot formation adapted to receive at least a portion of the scraper blade.

The carrier may be adapted removably to mount the scraper blade in any one of two or more operative positions in which the plane of the blade is located at different angles to the working face.

The carrier may include two or more slot formations. A slot formation may be provided for each of the operative positions, each slot formation being adapted to receive at least portion of the scraper blade and the different slot formations being disposed at different angles to the plane of the working face of the carrier.

Means may be provided for releasably securing the scraper blade in operative position on the carrier.

The securing means may comprise a backing fast with the carrier and located adjacent a slot formation, and means for clamping the scraper blade against the backing.

The clamping means may comprise a clamp member movable towards and away from the backing; and displacement means for urging the clamp member towards the backing.

The clamp member may be adapted to be resiliently biassed away from the backing.

Where two or more slot formations are provided, a backing may be provided adjacent each of the slot formations.

Where two slot formations each with its own backing are provided, common displacement means which is pivotally mounted on the carrier may be provided for urging a clamp member towards the one or the other backing.

With the arrangement of the preceding paragraph, a clamp member may be provided for each backing. Each such clamp member may be fast with its backing or may be removably mountable on its backing. Preferably, a common clamp member is removably and inter-changeably mountable on any one of the backings as required.

Means may be provided for adjustably controlling the position of the scraper blade in a direction transversely to the working face of the carrier.

The control means may comprise an adjustable stop member against which the back of the scraper blade may abut.

Also according to the invention there is provided a scraper device including a carrier which presents a working face and is adapted to mount a scraper blade in any one of two or more operative positions in which a longitudinally extending working edge of the scraper blade protrudes transversely from the working face, the plane of the blade being located at different angles to the working face of the carrier when the blade is in different operative positions.

Means may be provided for securing the scraper blade in any one of the operative positions, the securing means comprising a backing for each of the operative positions which is disposed at a suitable angle to the working face of the carrier; and means for clamping the scraper blade against any one of the backings.

The clamping means may comprise at least one clamp member movable towards and away from a backing; and common displacement means which is pivotally mounted on the carrier and is adapted to urge the clamp member towards the one or the other backing.

A clamp member may be provided for each backing and may either be fast therewith or removably mountable thereon. Alternatively, a common clamp member may be removably and inter-changeably mountable on any one of the backings as required.

A clamp member may be adapted to be resiliently biassed away from a backing.

The carrier may include a slot formation adjacent each backing, each slot formation being disposed substantially parallel to its adjacent backing and being adapted to receive a scraper blade.

Means may be provided for adjustably controlling the position of the scraper blade in a direction transversely to the working face of the carrier.

For a clear understanding of the invention a preferred embodiment will now be described by way of example with reference to the accompanying drawings in which.

The scraper comprises an elongate carrier 1 of channel shaped configuration having a base 2 presenting a plane working surface 2*a* and a pair of longitudinally extending and upstanding flanges 3. A pair of handles 4 are welded to carrier 1 at opposite ends thereof.

Figure 1:
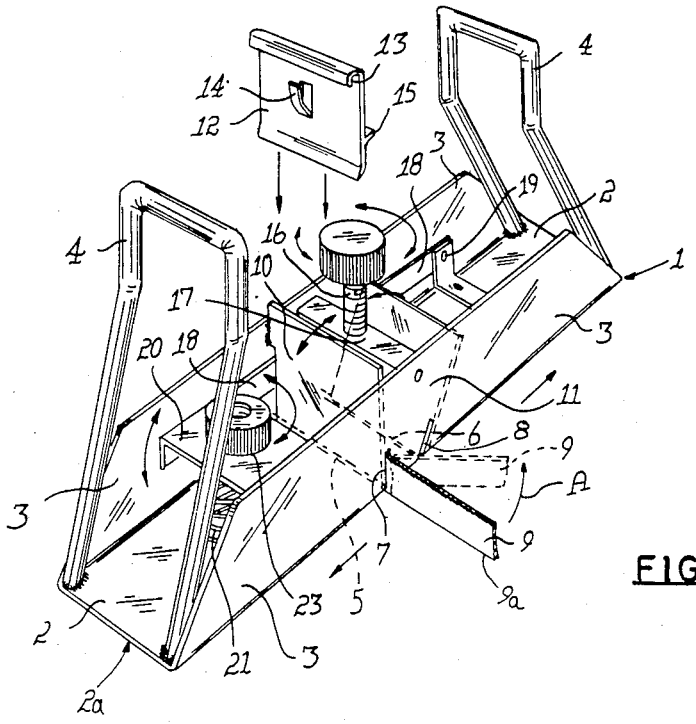
FIG. 1 is a partly exploded perspective view of a scraper according to the invention.
Figure 2:
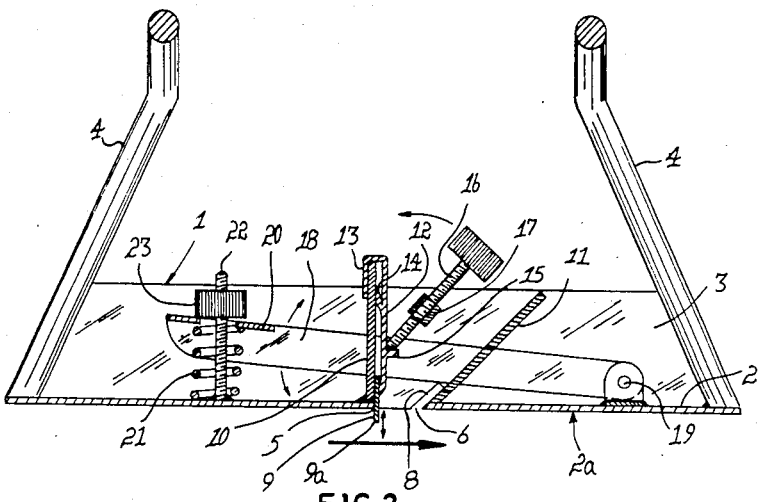
FIG. 2 is a longitudinal sectional view of the scraper of FIG. 1 showing a scraper blade in one of two alternative operative positions.
Figure 3:
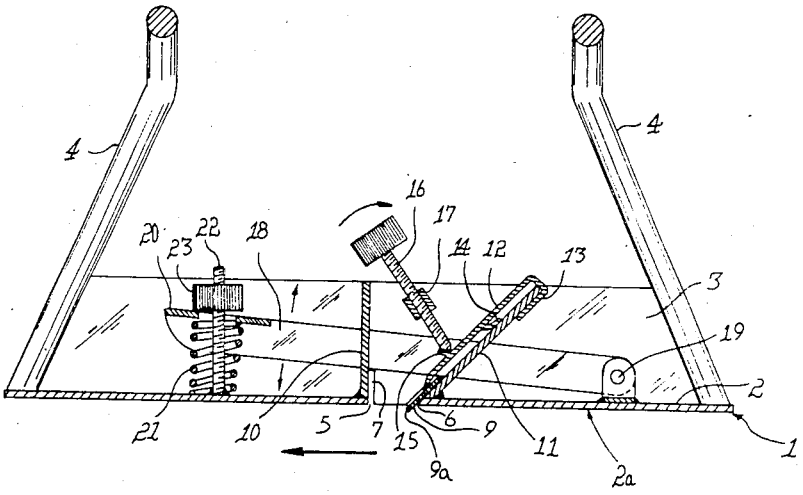
FIG. 3 is a longitudinal sectional view similar to that of FIG. 2 showing a scraper blade in the other operative position.

Intermediate its ends the base 2 of carrier 1 is provided with a pair of spaced slots 5, 6 which extend across the entire width of base 2 and communicate at opposite ends thereof with open ended slots 7, 8 respectively in upstanding flanges 3 of carrier 1. The slots 7 in flanges 3 are disposed at right angles to working face 2*a* and the slots 8 are disposed at any suitable angle, say 45°, to working face 2*a*. As shown in FIGS. 1 and 2, an elongate scraper blade 9 is receivable in transverse slot 5 in base 2 and in the associated slots 7 in flanges 3 so that the plane of scraper blade 9 is located at right angles to working face 2*a*. As shown in FIG. 3 a scraper blade 9 is also receivable in transverse slot 6 in base 2 and in the associated slots 8 in flanges 3 so that the plane of scraper blade 9 is located at an angle of 45° to working face 2*a*.

A backing plate 10 is located adjacent slots 5 and 7 between upstanding flanges 3 and are welded to flanges 3 and base 2. Backing plate 10 is disposed at right angles to working face 2a. Backing plate 11 is located adjacent slots 6 and 8 between upstanding flanges 3 and are also welded to flanges 3 and base 2. Backing plate 11 is disposed at the same angle as slots 8 to working face 2a. As shown in FIG. 2 a scraper blade 9 which is received in slots 5 and 7 is located in face-to-face abutting relationship with backing plate 10. As shown in FIG. 3 a blade 9 which is located in slots 6 and 8 is located in face-to-face abutting relationship with backing plate 11.

Clamp plate 12 is provided along its upper edge with a turned-over formation 13 which is adapted to be removably engageable over the upper edges of backing plates 10 and 11 so that clamp plate 12 is inter-changeably mountable on the one or the other of the two backing plates 10 and 11.

Clamp plate 12 includes a resilient tongue 14 which projects from one side thereof and is adapted resiliently to bias the plate 12 away from the backing plate 10 or 11 on which it is mounted. Clamp plate 12 also includes an abutment 15 on the opposite side thereof.

A displacement screw 16 is in screw-threaded engagement with a cross-member 17 which extends between and is pivotally mounted on upstanding flanges 3. As shown in FIG. 2, displacement screw 16 may be pivoted with cross-member 17 to one side so that its inner end is engageable with abutment 15 on clamp plate 12 when the latter is mounted on backing plate 10. By screwing-in displacement screw 16, clamp plate 12 may be displaced against the biassing influence of tongue 14 towards backing plate 10, thereby to clamp a scraper blade 9 against backing plate 10 so that scraper blade 9 is releasably secured in one operative position with the longitudinally extending working edge 9a of blade 9 protruding transversely from working face 2a. By unscrewing displacement screw 16, clamp plate 12 may be allowed to be displaced away from backing plate 10 under the resilient bias of tongue 14 on clamp plate 12, thereby to release scraper blade 9.

As shown in FIG. 3, displacement screw 16 may be pivoted with cross-member 17 to the other side so that its inner end is engageable with abutment 15 on clamp plate 12 when the latter is mounted on backing plate 11. By screwing-in displacement screw 16, clamp plate 12 may be displaced against the biassing influence of tongue 14 towards backing plate 11, thereby to clamp a scraper blade 9 which is located in slots 6 and 8, against backing plate 11 so that the scraper blade 9 is releasably secured in another operative position with its longitudinally extending working edge 9a protruding transversely from working face 2a. By unscrewing displacement screw 16, clamp plate 12 may be allowed to be displaced away from backing plate 11 under the resilient bias of tongue 14 on clamp plate 12, thereby to release scraping blade 9.

In order adjustably to control the position of a scraper blade 9 in a direction transversely to the working face 2a and to limit inward displacement of the blade 9 under the influence of operating forces, a pair of adjustable, elongate stop members 18 against which the back of a scraper blade 9 may abut, are located in transversely spaced relation between upstanding flanges 3 of carrier 1, one stop member 18 being located adjacent each flange 3. The elongate stop members 18 are pivotally mounted at one end thereof on base 2 of carrier 1 at 19 and the opposite ends of the stop members 18 are connected together by connecting member 20. A compressed spring 21 is located between base 2 of carrier 1 and connecting member 20 round upstanding stud 22 which is fast with base 2. Spring 21 is adapted resiliently to bias connecting member 20 and the elongate stop members 18 upwardly away from base 2. Adjustment nut 23 which is in screw-threaded engagement with stud 22 limits the upward displacement of stop members 18. By screwing adjustment nut 23 in the one or the other direction, the positions of stop members 18 may be adjusted, thereby to adjust the extent to which a scraper blade 9 may be pushed inwardly in a direction transversely to working face 2a.

It will be appreciated that during use the stop members 18 act to limit inward displacement of the scraper blade 9 under the influence of operating forces and adjustably controls the extent to which the working edge 9a of a scraper blade 9 protrudes from working face 2a. It will be seen from a comparison of FIGS. 2 and 3 that the stop members 18 are effective for both operative positions of the scraper blade 9.

In use, the handles 4 of the scraper may be gripped and with the working face 2a facing a surface to be scraped, the scraper may be moved to and fro over the surface in order to scrape the surface in order to smooth it and/or to remove a paint or other coating therefrom. A scraper blade 9 may be operatively mounted in any one of the two operative positions to suit particular circumstances and by suitable adjustment of stop members 18 the extent to which the scraper blade protrudes from working face 2a may be set to suit the particular circumstances.

It is possible to use a portion of a conventional hacksaw blade as the scraper blade. As can be seen from FIG. 1, an end portion of a hacksaw blade may be operatively mounted on carrier 1 in any one of the two operative positions so that the remainder of the hacksaw blade projects lengthwise from carrier 1 on one side thereof. By displacing the projecting portion of the hacksaw blade transversely to its own plane in the direction of arrow A in FIG. 1, the projecting portion of the hacksaw blade may be snapped off in the region where it emerges from the upstanding flange 3.

When the portion of the hacksaw blade which is operatively mounted on carrier 1 becomes worn, it may be removed and discarded. An end portion of the remaining portion of the hacksaw blade which was snapped off and removed from the scraper may then be operatively mounted on carrier 1 in any one of the two operative positions so that part of the remaining portion of the hacksaw blade projects lengthwise from carrier 1. The procedure described above may then be repeated.

It will be appreciated that successive portions of the hacksaw blade may be operatively mounted on the carrier one after the other as a preceding portion becomes worn and a projecting portion of the blade of progessively decreasing length may be snapped off for removal from the scraper each time a new portion of the blade is operatively mounted on the carrier.

It will be appreciated that by using hacksaw blades, readily available blades may be used and it is not necessary to provide specially produced blades for the scraper. It is, however, also possible to use specially produced blades.

Many variations in detail are possible without departing from the scope of the appended claims. Although it is convenient to use a portion of a conventional hacksaw blade as a scraper blade, it is not essential to do so and specially produced blades or any other suitable blades may be used.

Where specially produced blades are provided, the slots 7 and 8 in the upstanding flanges 3 of carrier 1 may be omitted, such a specially produced blade being of such length that it can fit in the space between flanges 3 and protrude through one or the other of the slots 5 or 6 in the base 2 of carrier. It will be appreciated that with such an arrangement, portions of conventional hacksaw blades may still be used as scraper blades, provided the hacksaw blade is first severed independently of the scraper into a plurality of portions of suitable length that can fit in the space between flanges 3.

I claim:

1. A scraper device comprising a carrier presenting a working face, the carrier being adapted removably to mount an elongate scraper blade such that a longitudinally extending working edge of the scraper blade protrudes transversely from the working face and portion of the scraper blade can project from the carrier on at least one side of the carrier to permit a projecting portion of the scraper blade to be severed from a portion of the blade which is operatively mounted on the carrier;

the carrier being adapted removably to mount the scraper blade in any one of at least two operative positions in which the plane of the blade is located at different angles to the working face;

the carrier including a slot formation for each of the operative positions, each slot formation being adapted to receive at least portion of the scraper blade and the different slot formations being disposed at different angles to the plane of the working face of the carrier;

said scraper device further including means adapted releasably to secure the scraper blade in any one of the operative positions on the carrier, the securing means composing a backing for each of the slot formations, each backing being fast with the carrier and located adjacent its slot formation; and means for clamping the scraper blade against any one of the backings, the clamping means comprising at least one clamp member movable towards and away from a backing; and common displacement means which is pivotally mounted on the carrier and is adapted to urge the clamp member towards the one or the other backing.

2. A scraper device as claimed in claim 1, wherein a clamp member is provided for each backing.

3. A scraper device as claimed in claim 1, wherein a common clamp member is removably and inter-changeably mountable on any one of the backings as required.

4. A scraper device as claimed in claim 1, including means adapted adjustably to control the position of the scraper blade in a direction transversely to the working face of the carrier.

5. A scraper device as claimed in claim 4, wherein the control means comprises an adjustable stop member against which the back of the scraper blade may abut.

6. A scraper device as claimed in claim 1, including control means adapted adjustably to control the position of the scraper blade in a direction transversely to the working face of the carrier, the control means comprising an adjustably mounted elongate stop member against which the back of the scraper blade may abut when the scraper blade is in any of its operative positions; and adjustment means adapted to adjust the position of the stop member relative to the working face and thereby adjust the extent to which the scraper blade may be displaced inwardly in a direction transversely to the working face under the influence of operating forces.

* * * * *